United States Patent [19]

Lee et al.

[11] Patent Number: 4,685,656

[45] Date of Patent: Aug. 11, 1987

[54] MOTOR RACING TRACK FENCE

[75] Inventors: Kevin J. Lee, Adelaide; Noel C. Carty, Panorama, both of Australia

[73] Assignees: Pak-Poy & Kneebone Pty Ltd., Adelaide; Humes Limited, Melbourne, both of Australia

[21] Appl. No.: 882,465

[22] Filed: Jul. 7, 1986

[51] Int. Cl.[4] ..... A01K 3/00

[52] U.S. Cl. ..... 256/13.1; 256/19; 256/24

[58] Field of Search ..... 256/13.1, 24, 19, 26; 404/6

[56] References Cited

U.S. PATENT DOCUMENTS 1,012,868 12/1911 Laney ..... 256/19

3,423,072 1/1969 Bernstein ..... 256/24

FOREIGN PATENT DOCUMENTS 1501586 10/1967 France ..... 256/24

2005200 12/1969 France ..... 256/13.1

*Primary Examiner*—Andrew V. Kundrat

*Attorney, Agent, or Firm*—Edward W. Callan

[57] ABSTRACT

A motor racing track fence comprising a plurality of fence modules each of which has a concrete barrier the area of the base of which is sufficient for it to be free-standing on the ground, having an upstanding sleeve adjacent one end of each concrete barrier and abutting another concrete barrier, the sleeve supporting upstanding support means which lie at the ends of weldmesh sheets surmounting the concrete barriers.

6 Claims, 6 Drawing Figures

FIG 1
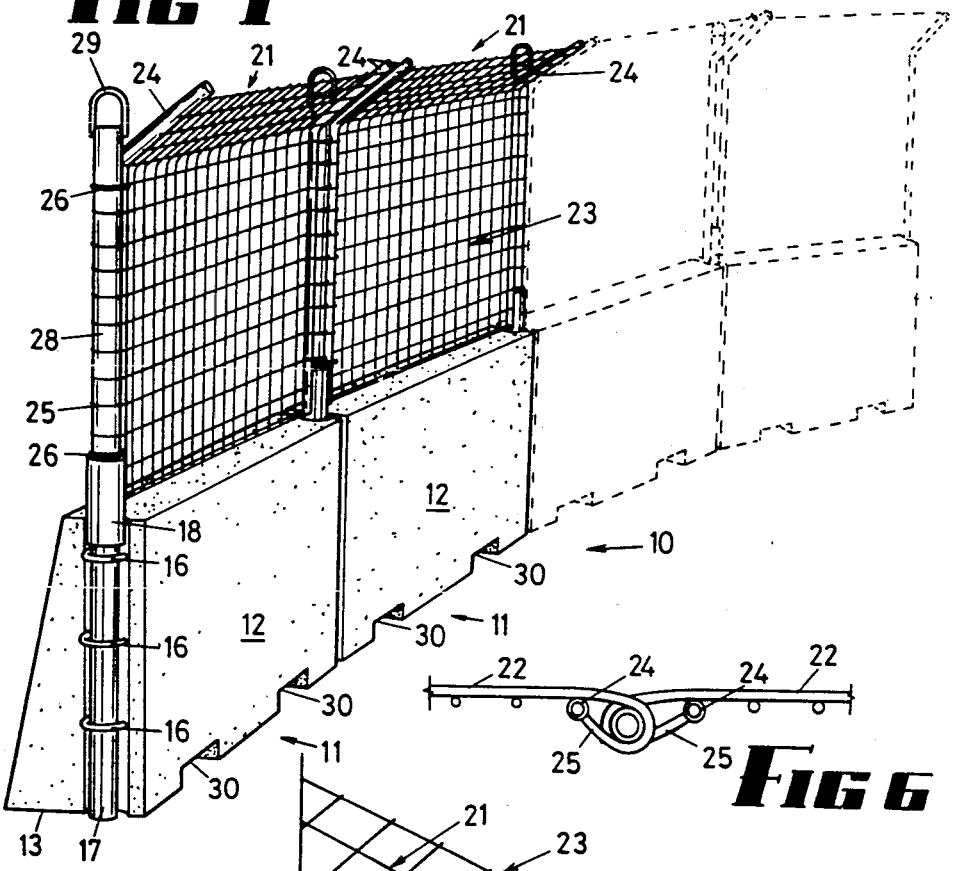
FIG 6
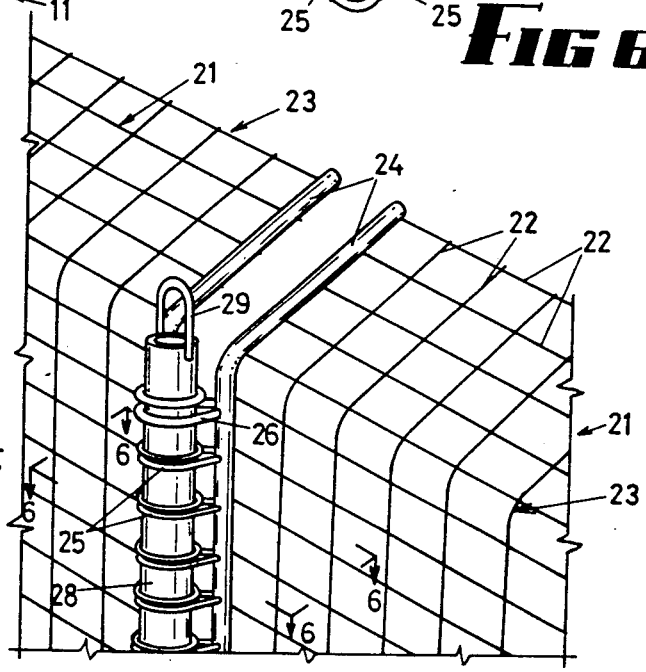
FIG 5

MOTOR RACING TRACK FENCE

This invention relates to a safety fence which is suitable for a motor racing track of the type wherein use is made of existing roadways and it is necessary to have a fence which can be readily installed and removed.

BACKGROUND OF THE INVENTION

Certain types of motor racing (for example Formula 1 Grand Prix) traditionally takes place on tracks which include, or consist solely of, existing roadways, and it is therefore not feasible to have a track fence as a permanent installation, but the track fence must necessarily be capable of being erected and removed quickly and easily. It is also desirable that the interference with the existing road construction should be minimal.

Traditionally fences have been made with chain wire mesh forming a debris fence portion surmounting a concrete barrier, but chain mesh is not always strong enough to protect spectators on the outer side of the fence against such debris as runaway wheels which may be travelling at very high speed. Chain mesh is a material formed from wire, generally about 2.5 mm in thickness, the wire being interlaced and having portions which are bent from the plane of the fence so that there is a high degree of resilience. While resilience is desirable in one respect, that is that the deflection of the chain mesh enables the kinetic energy to be absorbed over a length of the fence, the resilience is undesirable in that the chain mesh is essentially supported by bar-like stiffeners, and if the mesh has been deflected the bar-like stiffeners can be subjected to direct impact forces which can be destructive of the fence. Furthermore, chain mesh interferes with spectator viewing.

One object of the invention therefore is to provide improvements whereby the debris portion of the fence is much stiffer, and in an embodiment of the invention use is made of weldmesh panel assemblies upstanding from the upper surfaces of concrete barriers, each panel assembly comprising a panel of weldmesh sheet supported at its ends by upstanding bar-like stiffeners. Weldmesh sheet is a sheet of material having wires extending in one direction overlying wires extending at right angles thereto and welded at each intersection. The wires are straight and are usually much thicker and stronger than the wires of chain mesh, and thereby the weldmesh panels will provide additional protection for the barlike stiffeners which are used to support them.

Race tracks which are used require closed circuits and therefore the fence must be not only capable of withstanding the very great forces imposed upon it by a motor vehicle crash, but must also be positionable either in a straight line, or in a curve the concave side of which faces the race track, or in a curve the convex side of which faces the race track, and a further object of the invention is to provide improvements whereby the advantages of weldmesh panels can be achieved and fence modules can be arranged either in line, or can hinge with respect to one another so as to be either convexly or concavely.

BRIEF SUMMARY OF INVENTION

Briefly in this invention a motor racing track fence comprises a plurality of fence modules each of which has a concrete barrier the area of the base of which is sufficient for it to be freestanding on the ground, having an upstanding sleeve adjacent one end of each concrete barrier and abutting another concrete barrier, the sleeve supporting upstanding support means which lie at the ends of weldmesh sheets surmounting the concrete barriers.

More specifically, in an embodiment of the invention a racing track fence comprises a plurality of fence modules, each said module comprising a concrete barrier, a sleeve upstanding from one end of said barrier, a weldmesh panel assembly upstanding from an upper surface of said barrier, said panel comprising a weldmesh sheet and bars secured to respective side edges of the weldmesh sheet, a plurality of panel loops outstanding from said bars and a plurality of panel pins having their lower ends engaging within and supported by respective said sleeves, each said pin extending through aligned said panel loops of a pair of adjacent said weldmesh panels thereby joining those said end mesh panels end-to-end.

The pins can perform the function of being primary stiffeners, and in a preferred embodiment the bars at the ends of the panel assemblies have the horizontal wires of the weldmesh sheet welded to them and thereby the panel loops are rigid with respect to the panels, the pins however forming the primary function of providing additional support for the panel assemblies.

BRIEF DESCRIPTION OF THE DRAWINGS

An embodiment of the invention is described hereunder in some detail with reference to and is illustrated in the accompanying drawings in which:

FIG. 1 is a perspective view of portion of a motor racing track according to the invention, showing a plurality of fence modules joined end-to-end, FIG. 5 is a fragmentary rear view of the upper ends of two fence modules showing the manner in which the pins extend through the aligned panel loops and join the mesh panels end-to-end, and FIG. 6 is a plan section taken on plane 6—6—6—6 of FIG. 5.

DETAILED DESCRIPTION OF PREFERRED EMBODIMENT

Figures 2, 3:
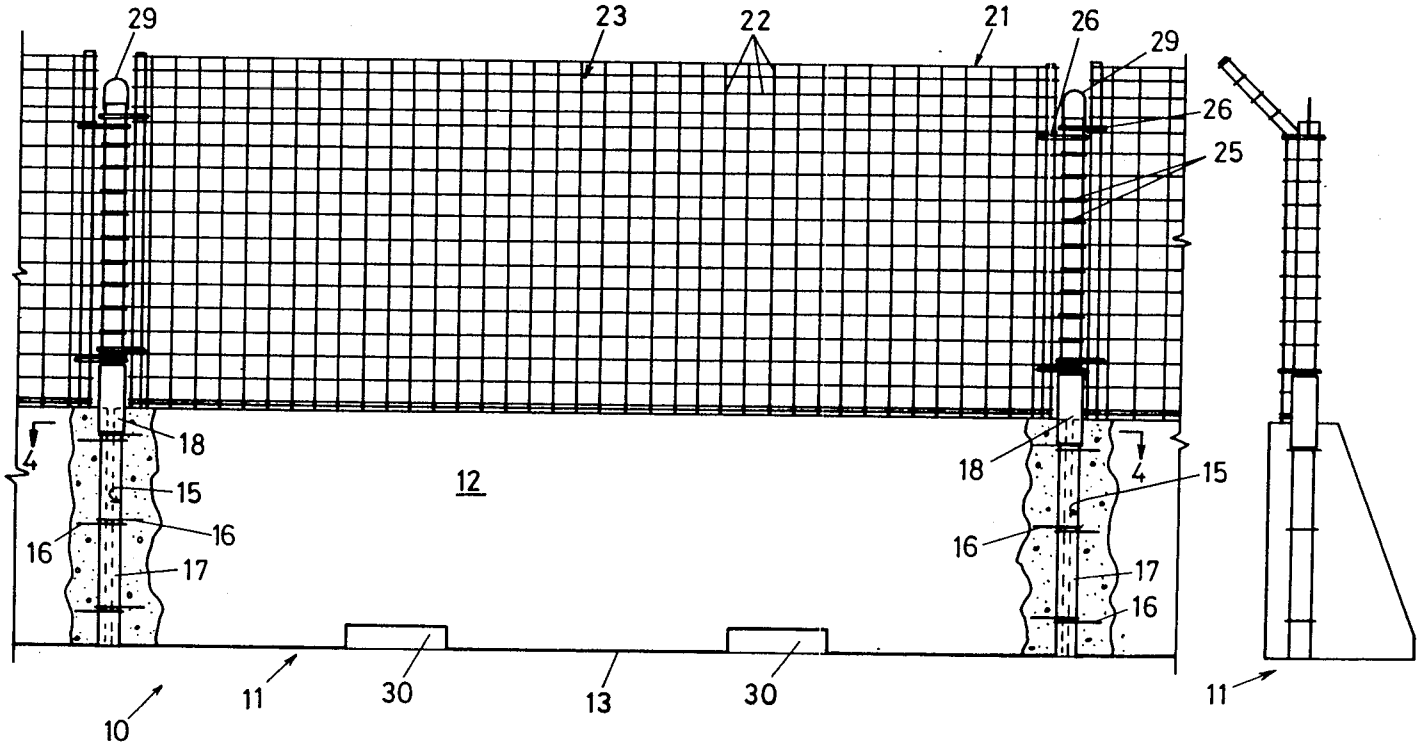
FIG. 2 is a front elevation of a fence module.
FIG. 3 is an end elevation of FIG. 2.

In this embodiment a motor racing track fence 10 comprises a plurality of fence modules 11, and each module 11 comprises a concrete barrier 12 which widens towards its base 13 so that the barrier can be freestanding without the need for penetrating the earth to retain it in position. It is important that the barriers 12 should have considerable mass because of the possibility of impact by a fast moving motor vehicle under crash conditions.

Figure 4:
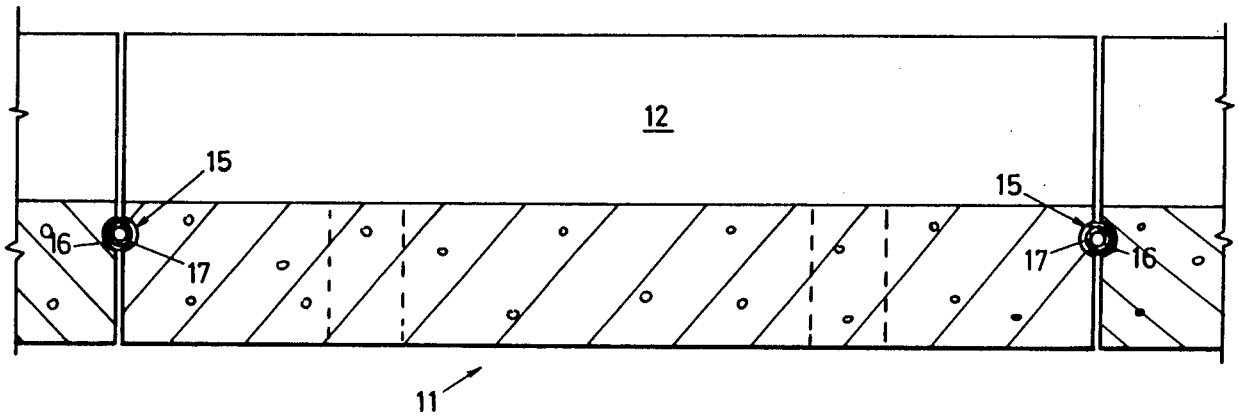
FIG. 4 is a plan section of the concrete barrier of the fence module taken on line 4—4 of FIG. 2.

As seen best in FIG. 4, each barrier 12 is provided with a groove 15 at each respective end, and a plurality of rods embedded in the concrete extend as looped ends 16 to provide barrier loops which co-operate with the groove surfaces in such a way that when two barriers are located end to end, the loops overlap and the barriers are retained together by barrier pins 17, each barrier pin 17 being a rigid tubular memberwhich performs the primary function of providing support for the panel assemblies. Each barrier pin 17 terminates at its upper end in a sleeve 18, there being one sleeve 18 for each barrier 12 (except for the barrier at the ends of a fence section which of course will require two barrier pins).

Besides its concrete barrier 12, each fence module 11 comprises a weldmesh panel assembly 21 wherein the rods 22 of the weldmesh panel 23 are substantial, in this embodiment the vertical rods being 5 mm diameter and the longitudinal rods 10 mm diameter. The ends of the weldmesh panel 23 are welded to bars 24 (which are best formed from metal tube) but some of the horizontal rods 22 extend beyond the bars 24, and are bent around in loops 25 as best seen in FIG. 5, the ends then being welded back on to the bars 24. In addition to the panel loops 25 there are provided further secondary loops 26 welded near the upper and lower ends of the bars 24 and these secondary loops provide additional strength for the interconnecting of the panel assemblies 21 end to end. Secondary loops 26, panel loops 25 and the barrier loops 16 all lie along one vertical axis, such that panel pins 28 are inserted between the overlapping loops of adjacent panel assemblies 21 to retain the panel assemblies 21 end to end and to provide longitudinal continuity of strength between panel assemblies. The panel pins 28 are coaxial with the barrier pins 17. This enables the modules 11 to be arranged either in alignment, to be concave towards the track or to be convex towards the track.

When it is desired to erect or remove the fence, this is done very simply by withdrawal of the pins, firstly between the debris fence portions and secondly between the barrier fence portions. To facilitate removal, the panel pins 28 are surmounted by lifting loops 29, and the barriers 12 are provided with upwardly extending recesses 30 which enable lifting means to be positioned beneath them.

We claim:

1. A motor racing track fence comprising a plurality of fence modules each said module comprising a concrete barrier, an upstanding sleeve adjacent one end of said barrier, a weldmesh panel assembly upstanding from an upper surface of said barrier, said panel comprising a weldmesh sheet and bars secured to respective side edges of the weldmesh sheet, a plurality of panel loops outstanding from said bars, and a plurality of panel pins having their lower ends engaging with respective said sleeves, each said pin extending through aligned said panel loops of a pair of adjacent said weldmesh panels thereby joining those said mesh panels end-to-end.

2. A motor racing track fence according to claim 1 wherein each said concrete barrier has a pair of grooves in respective ends, and a plurality of barrier loops at the locality of each end, and further comprising a plurality of barrier pins, each said barrier pin lying in adjacent said grooves and extending through aligned said barrier loops of a pair of adjacent said barriers thereby joining those said barriers end-to-end.

3. A motor racing track fence according to claim 2 wherein each said sleeve is upstanding from and co-axial with a respective said barrier pin, and also co-axial with the lower end of a respective said panel pin.

4. A motor racing track fence according to claim 2 or claim 3 wherein each said barrier has a base surface of sufficient area for said barriers to be free-standing.

5. A motor racing track fence according to claim 1 wherein said panel loops comprise looped ends of horizontal rods of said weldmesh sheet.

6. A motor racing track fence according to claim 5 wherein said panel loops further comprise secondary loops having ends welded to said bar-like stiffeners, said secondary loops being stiffer than said rod looped ends.

* * * * *